United States Patent [19]

Sakai

[11] 4,384,033

[45] May 17, 1983

[54] PROCESS OF SYNTHESIZING AND RECORDING IMAGES

[75] Inventor: Katsuo Sakai, Yokohama, Japan

[73] Assignee: Ricoh Company, Ltd., Tokyo, Japan

[21] Appl. No.: 217,555

[22] Filed: Dec. 17, 1980

[30] Foreign Application Priority Data

Dec. 18, 1979 [JP] Japan ..... 54/164282

[51] Int. Cl.[3] ..... G03G 13/01

[52] U.S. Cl. ..... 430/42; 430/31; 430/57; 430/363; 430/945

[58] Field of Search ..... 430/31, 42, 57, 363, 430/945

[56] References Cited

U.S. PATENT DOCUMENTS

| | | | |
|---|---|---|---|
| 3,909,254 | 9/1975 | Tamai et al. | 430/31 X |
| 4,149,798 | 4/1979 | McGowan et al. | 430/49 X |
| 4,189,224 | 2/1980 | Sakai | 355/4 |
| 4,250,239 | 2/1981 | Sakai | 430/57 |
| 4,281,051 | 7/1981 | Sakai | 430/42 |

*Primary Examiner*—Roland E. Martin, Jr.

*Attorney, Agent, or Firm*—Guy W. Shoup; Gerard F. Dunne

[57] ABSTRACT

A photographic member includes an electrically conductive substrate which carries a pair of photoconductive layers thereon, which are charged to opposite polarities from each other, as will be further defined herein. The photosensitive member has a surface potential which is of either positive or negative polarity. Subsequently, the photosensitive member is imagewise exposed to light image formed by light of a wavelength which principally renders only one of the photoconductive layers conductive. Areas of the photosensitive member which are irradiated by the light radiation during the imagewise exposure is subjected to a line scanning by a light spot having an extremely small diameter and of a wavelength which principally renders the other conductive layer conductive either simultaneously with or after the imagewise exposure. The spot has a reference light intensity, which is modulated by a pair of write signals. One of the write signals effects an intensity modulation so that the light intensity of the spot becomes substantially zero while the other write signal effects an intensity modulation which increases the light intensity of the spot above the reference intensity. As a result of the line scanning, the pair of write signals produces an electrostatic latent image in the form of a distribution of surface potentials of opposite polarities. The electrostatic latent image which is formed by the line scanning and an electrostatic latent image formed by the imagewise exposure are both converted into visual images by a developing step using a pair of toners which are charged to opposite polarities from each other.

16 Claims, 4 Drawing Figures

PROCESS OF SYNTHESIZING AND RECORDING IMAGES

BACKGROUND OF THE INVENTION

The invention relates to a process of synthesizing and recording images.

A process of recording a plurality of synthesized images is disclosed in Japanese Patent Application No. 055,788/1978 in which a combination of an imagewise exposure and a line scanning by light is applied to a photoconductive, photosensitive member.

Specifically, in this process, a conductive substrate carries at least first and second photoconductive layers, which are overlaid thereon in the sequence named. Such a photoconductive member is prepared in a manner such that principally one of the photoconductive layers is rendered conductive in response to irradiation with light of a color A while the other photoconductive layer is principally rendered conductive in response to irradiation with light of a color B. By exposing the photosensitive member to a primary charging and a secondary charging which is of the opposite polarity to the primary charging, the pair of photoconductive layers are charged to the opposite polarities. Subsequently, the photosensitive member is with an image formed by exposed to light of a wavelength which principally renders the second photoconductive layer conductive to reduce the surface potential of the photosensitive member in the exposed areas to zero substantially, followed by a line scanning of the exposed areas with two light spots having an extremely small diameter and of wavelengths corresponding to colors A and B which are modulated in intensity by different write signals, thereby having electrostatic latent images corresponding to the two write signals formed on the exposed areas in the form of a distribution of surface potentials of opposite polarities. An electrostatic latent image formed by the imagewise exposure and the electrostatic latent images corresponding to the write signals are converted into visual images by utilizing two toners having different colors and which are charged to opposite polarities from each other.

However, the implementation of the process requires two light sources which produce light of different colors, presenting problems that the arrangement becomes expensive and bulky in size.

SUMMARY OF THE INVENTION

It is an object of the invention to provide a process of synthesizing and recording images which is similar to the process mentioned above and capable of synthesizing and recording three or more images through an imagewise exposure and a line scanning by a spot of light of a given wavelength of a photosensitive member having a composite structure.

In accordance with the invention, a photosensitive member includes an electrically conductive substrate on which at least first and second photoconductive layers are laminated. The term "at least first and second photoconductive layers" is used because the photosensitive member may include an intermediate layer, a transparent dielectric film and a dielectric layer. The intermediate layer may be interposed between the photoconductive layers. The transparent dielectric film may be overlaid on top of the second or upper photoconductive layer. The dielectric layer may be interposed between the conductive substrate and the first conductive layer.

One or more of the intermediate layer, the transparent dielectric film and the dielectric layer may be used as desired. Accordingly, in its simplest form, the photosensitive member comprises a three-layer structure including the conductive substrate and the pair of photoconductive layers. In its most complex form, it comprises the conductive substrate, the pair of photoconductive layers, the intermediate layer, the transparent dielectric film and the dielectric layer, and thus is a six-layer sturcture.

In the photosensitive member used in the present invention, the pair of photoconductive layers are charged to opposite polarities from each other. The surface potential of the photosensitive member is of either positive or negative polarity.

Initially, the photosensitive member is imagewise exposed to a light image of a positive original, utilizing light of a wavelengthh which principally renders only one of the photosensitive layers conductive.

As a result of such imagewise exposure, the surface potential assumes opposite polarities in the exposed and the unexposed areas.

Either simultaneously with or after the imagewise exposure, the exposed areas are subject to a line scanning by a light spot having an extremely small diameter. The light which forms the spot has a wavelength which principally renders only the other photoconductive layer conductive. information which is to be synthesized with the image of the original is written in the photosensitive member through a line scanning by the spot. Specifically, the light intensity of the spot is modulated by a pair of write signals, one of which corresponds to information of one image and which modulates the light intensity of the spot in a manner such that the light intensity decreases from a reference value to substantially zero. The other write signal modulates the light intensity of the spot so that it increases above the reference value. The reference value of the light intensity is one which renders the surface potential of the photosensitive member substantially opposite polarity when the latter is subject to a line scanning by the spot having such intensity.

In the manner mentioned above, an electrostatic latent image which corresponds to two information images is formed on the photosensitive member as a distribution of surface potentials of opposite polarities. The electrostatic latent image formed by the line scanning and electrostatic latent image formed by the imagewise exposure are developed and thus converted into visual images, utilizing two toners which are charged to opposite polarities from each other. A resulting visible image formed on the photosensitive member is directly fixed thereto for a photosensitive member of a sheet form or is transferred onto a record sheet before fixing where the photosensitive member is shaped otherwise. With the described process, a single light can be used to achieve the line scanning, and hence an apparatus which is used to carry out the recording process can be simplified and the cost reduced.

DESCRIPTION OF EMBODIMENT

Figure 1:
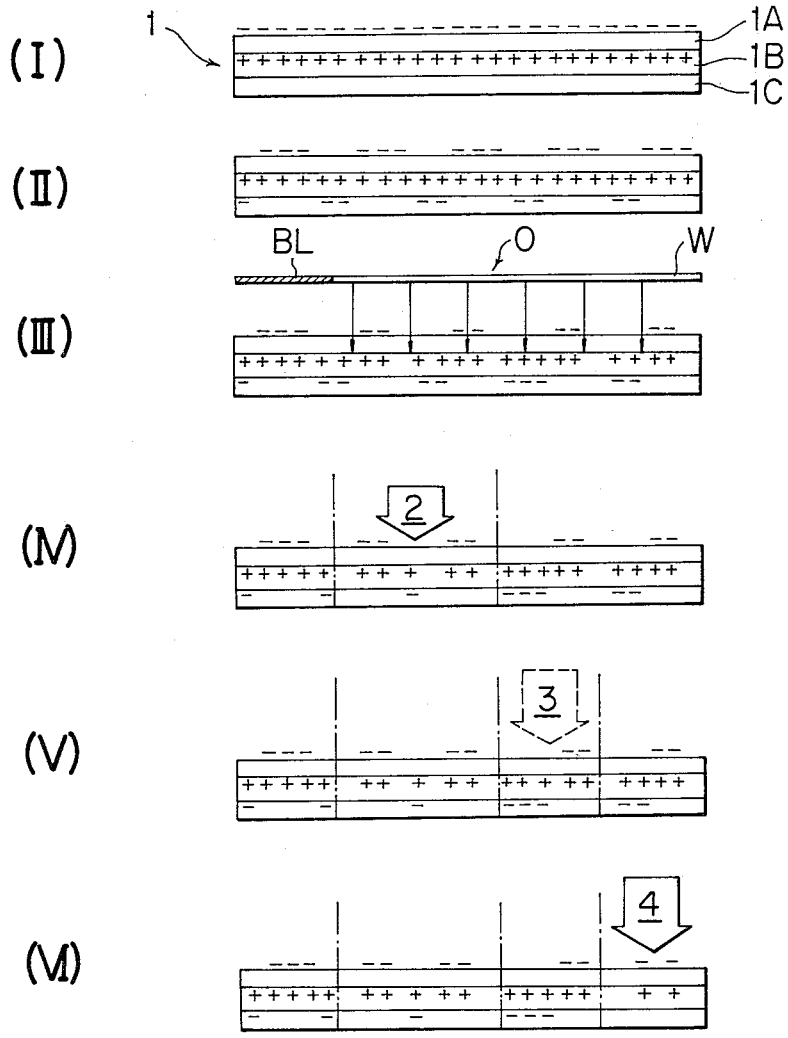
FIG. 1 is a series of schematic cross sections of a photosensitive member, illustrating the various steps of the recording process according to the invention.

Referring to FIG. 1, there is shown one form of a photosensitive member 1 which is used to carry out the present invention. The photosensitive member 1 includes an electrically conductive substrate 1C on which a first photoconductive layer 1B and a second photoconductive layer 1A are laminated in the sequence named.

The photosensitive member 1 is prepared in a manner such that the irradiation thereof with light of a color A principally renders only one of the photoconductive layers 1B, 1A conductive while the irradiation thereof with light of a color B principally renders only the other photoconductive layer conductive. In the description to follow, it is assumed that the irradiation with light of a color A principally renders the photoconductive layer 1A conductive while the irradiation of light of a color B principally renders the photoconductive layer 1B conductive. It is to be understood that the expression "light of a color A" represents light of a wavelength which principally renders the photoconductive layer 1A conductive, and the expression "light of a color B" represents light of a wavelength which principally renders the photoconductive layer 1B conductive. The first step of the recording process comprises a primary charging of the photosensitive member 1. While the primary charging may be of either negative or positive polarity depending on the actual construction of the photosensitive member 1, it is assumed for the convenience of description that the negative polarity is chosen. When the interface between the conductive substrate 1C and the photoconductive layer 1B has a rectifying effect upon a positive hole, the primary charging may be performed in darkness. However, if the rectifying effect is absent, the photoconductive layer 1B is rendered conductive by a uniform illumination thereof with light of a color B. As a result of such primary charging, an electric double layer is formed through the interposition of the photoconductive layer 1A (see (I) of FIG. 1), and this condition is referred to herein by the statement that photoconductive layer 1A is charged.

Subsequently, a secondary charging of the opposite polarity from that of the primary charging, namely, of the positive polarity, is effected to cancel part of the negative charge produced by the primary charging. The secondary charging takes place in darkness. When part of the negative charge on the surface of the photosensitive member is cancelled as a result of the secondary charging, there will be an excess of positive charge on the inner surface of the photoconductive layer 1A with respect to the quantity of negative charge on the surface, whereby a quantity of negative charge which balances the excess is induced on the interface between the conductive substrate 1C and the photoconductive layer 1B (se (II) of FIG. 1). In this manner, part of the positive charge on the inner surface of the photoconductive layer 1A forms an electric double layer with the negative charge on the surface of this layer while the remainder forms another electric double layer with negative charge on the interface. In this manner, the photoconductive layer 1B as well as the photoconductive layer 1A are charged, with the vectors of the dipole moments in the respective layers being directed in opposite directions. For this reason, such condition is referred to by the statement that the photoconductive layers 1A, 1B are charged to the opposite polarities. The photoconductive layers 1A, 1B of the photosensitive member 1 can be charged to the opposite polarities, not only by the steps mentioned above, but also by alternative techniques. By way of example, a primary charging of the positive polarity may be effected by a uniform illumination with light of a color A, followed by a secondary charging of the negative polarity in darkness, thus achieving the same result as indicated in FIG. 1 (II).

The surface potential of the photosensitive member subsequent to the secondary charging can be made either a positive or negative polarity depending on the manner in which the secondary charging takes place. Alternatively, the surface potential can be made zero. However, in the present instance, it must be of a negative polarity.

The photosensitive member 1 is now exposed to a light image of an original 0 which has a color A (see FIG. 1 (III)). The exposure can be performed by illuminating the original with light of color A, with its reflected light directed for exposure of the photosensitive member. Alternatively, the original may be irradiated with light of a white color, and its reflected light passed through a filter to pass a light component of a color A alone, which is fed for exposure of the photosensitive member.

It will be seen that the surface potential of the photosensitive member remains to be of a negative polarity in those areas which correspond to black image areas BL of the original 0 since those areas of the photosensitive member are not exposed. It is to be understood here that the term "black image" refers not only an image area having an originally black color, but also an image area of a color which is complementary to the color A since the latter image exhibits the same behavior as a black image with respect to the exposure of the photosensitive member with light of the color A.

A surface area of the photosensitive member which corresponds to a white background W of the original will be irradiated with light of the color A, whereby the photoconductive layer 1A is rendered conductive, causing the electric doublelayer of this layer to be extinguished in a gradual manner. This means that the negative charge of the surface of the photosensitive member is also gradually extinguished, and the surface potential of the negative polarity gradually diminishes in the exposed areas until the surface potential of the photosensitive member is inverted to a positive polarity, followed by a gradual increase of the surface potential of the positive polarity. The increase in the surface potential of the positive polarity continues until the negative charge on the surface of the photosensitive member is completely extinguished. However, in carrying out the invention, the exposure of the photosensitive member with light of the color A from the original 0 is interrupted at the moment when the surface potential of the exposed portions of the photosensitive member have effectively inverted to a positive polarity, but there is still a significant amount of negative charge on the surface areas which have not been exposed. Thus, at the termination of the exposure, the surface potential of the photosensitive member will be of a negative polarity in those areas corresponding to a black image or images of the original and will be of a positive polarity in those areas which correspond to the white background of the original, but there still remains a sufficient amount of negative charge on the surface in the areas corresponding to the white background.

Subsequently, a light spot having a sufficiently small diameter and of the color B is used to effect a line scanning of the exposed areas of the photosensitive member 1, that is, those areas which now assume a positive surface potential.

Before continuing the description of the operation of the invention, the effect of the light spot of the color B upon the photosensitive member 1 will be considered. When the light spot of the color B irradiates the exposed areas, the photoconductive layer 1B will be principally rendered conductive, whereby the electric double layer formed by this layer will be diminished in a gradual manner. This means that the positive charge on the inner surface of the photoconductive layer 1A diminishes gradually. Observation of a change in the surface potential of the photosensitive member in those areas which have been irradiated by the spot reveals that the surface potential initially assumes a positive polarity, and gradually diminishes until a surface potential of a negative polarity is produced, which increases until the charged condition of the photoconductive layer 1B is completely extinguished.

The light spot of the color B is modulated in intensity by a first and a second write signal. Specifically, the intensity of the light of the color B is established at a reference intensity in the absence of a signal applied. The first write signal modulates the intensity of the spot having the color B so that the intensity becomes substantially zero while the second write signal modulates it so that the intensity of the spot light increases above the reference intensity. Either signal modulates the intensity of the light having the color B whenever it assumes a signal level corresponding to an image.

The reference intensity is chosen in connection with the rate of the line scanning and other factors in a manner to be mentioned below. FIG. 1 (IV) indicates light 2 of the color B and having the reference intensity. This light is in no way modulated by either signal. The reference intensity is chosen so that the surface potential of the photosensitive member becomes substantially zero in those exposed areas which have been subjected to a line scanning by the light spot 2 of the color B and having the reference intensity.

FIG. 1 (V) illustrates light 3 of the color B which has been modulated by the first write signal. Since this light has an intensity which is substantially zero, the photosensitive member 1 is not substantially irradiated by the light spot of the color B, and consequently, the surface potential of the photosensitive member remains to be a positive polarity in such areas.

FIG. 1 (VI) illustrates light 4 of the color B which is modulated by the second write signal. The intensity of the light of the color B increases above the reference value as a result of the modulation, so that the surface potential of the photosensitive member in such area is again inverted to the negative polarity.

Figure 2:
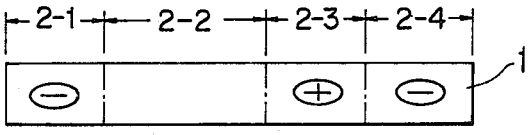
FIG. 2 is a schematic cross section of a photosensitive member illustrating an electrostatic latent image which is formed according to the process shown in FIG. 1.

FIG. 2 shows a distribution of the surface potential of the photosensitive member after the termination of the line scanning by the spot. In an area 2-1 which corresponds to a black imagea area BL (FIG. 1 (III)) of the original 0 during the imagewise exposure, the surface potential of the photosensitive member assumes a negative polarity as indicated by a symbol ⊖. On the other hand, in an area 2—2 which has been scanned by the light spot of the color B and having the reference intensity during the line scanning, the surface potential of the photosensitive member is substantially zero. In an area 2-3 which has been scanned by the light spot of the color B which has been modulated by the first write signal, the surface potential of the photosensitive member assumes a positive polarity as indicated by a symbol ⊕.

On the other hand, the surface potential of the photosensitive member assumes a negative polarity in an area 2-4 which has been scanned by the light spot of the color B which has been modulated by the second write signal.

To summarize, under the condition illustrated, the surface of the photosensitive member exhibits a distribution of surface potentials of both positive and negative polarities, and such distribution of positive surface potential forms an electrostatic latent image which is patterned according to the first write signal while the distribution of the negative surface potential of the photosensitive member forms an electrostatic latent image of a synthetic or composite pattern which comprises the black image on the original 0 and a pattern corresponding to the second write signal.

Figure 3:
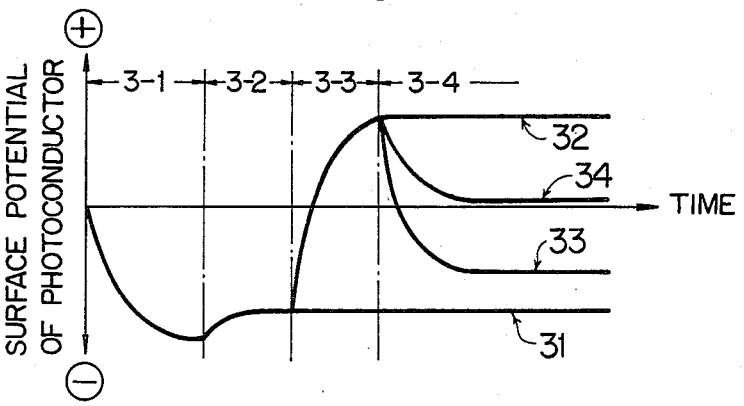
FIG. 3 graphically illustrates a variation in the surface potential of the photosensitive member with time during the recording process of the invention.

FIG. 3 diagrammatically illustrates a change in the surface potential of the photosensitive member in the course of the described steps. Specifically, a time interval indicated by numeral 3-1 corresponds to that of the primary charging while the time intervals designated by numerals 3-2, 3-3 and 3-4 correspond to the secondary charging, the imagewise exposure to the original 0 with light of the color A, and the line scanning by the light spot having the color B, respectively. In this graph, a curve designated by numeral 31 represents the potential of an area which corresponds to a black image on the original 0, a curve 32 represents the potential of a patterned area corresponding to the first write signal, a curve 33 represents the potential of a patterned area corresponding to the second write signal, and a curve 34 represents the potential of an area which has been scanned by the light spot of the color B and having the reference intensity. It is to be understood that the starting points of the curves 32, 33 and 34 have been brought to a single point for the convenience of illustration.

Figure 4:
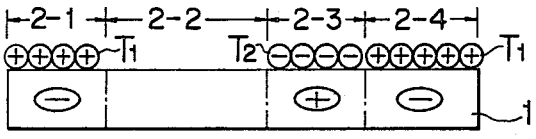
FIG. 4 schematically illustrates the developing of an electrostatic latent image formed by the recording process of the invention.

There now remains the problem of converting the electrostatic latent images formed on the photosensitive member 1 into a visual image. This can be accomplished by merely employing two toners T1, T2 which are charged to the opposite polarities from each other. As a result of such developing step, a visual image is formed on the photosensitive member 1 by the pair of toners T1, T2 as shown in FIG. 4. The visual image can be fixed on the photosensitive member 1 to serve as a record where the photosensitive member 1 is in the form of a sheet, or may be transferred onto a suitable record sheet and fixed thereon to serve as a record. It will be appreciated that the record can be formed in two colors by utilizing toners T1, T2 of different colors.

A specific example will now be described. An electrically conductive substrate comprises a drum of aluminum, and $As_2Se_3$ is deposited on the peripheral surface of the drum to thickness of 35μ by evaporation under the substrate temperature of 74° C., thus forming the first photoconductive layer. The resulting assembly is maintained in darkness for one week to stabilize the response. Subsequently, a 1.5μ thick coating of polyester resin layer with which Rose Bengal is mixed and kneaded is deposited thereon to form an intermediate layer. Then, OPC including hydrazone compound and disazo pigment, a test product by RICOH (refer to U.S. Ser. No. 898,130 filed Apr. 20, 1978), is overcoated on the intermediate layer to a thickness of 22μ by dipping process, thus providing the second photoconductive layer. When the photosensitive member thus formed is irradiated with light of green color, only the OPC layer which represents the second photoconductive layer is rendered conductive. The first photoconductive layer which comprises $As_2Se_3$ exhibits a panchromatic light sensitivity, and hence has a good response to light of green color, but the light of green color cannot reach the first photoconductive layer since the intermediate layer acts as a filter which interrupts the transmission of the green light.

On the other hand, when the photosensitive member is irradiated with light of red color, only the first photoconductive layer which comprises $As_2Se_3$ is rendered conductive since the OPC layer has little light sensitivity to red light and thus exhibits a good transmission thereof together with the intermediate layer.

The photosensitive member is set in motion with a peripheral speed of 78 mm/sec, and a corona charger is utilized to which a discharge voltage of −6.5 kV is applied to effect the primary charging of the negative polarity in darkness. (It is to be noted that a rectifying property for the positive hole exists between the $As_2Se_3$ layer of the first photoconductive layer and the aluminium drum which represents the conductive substrate). Subsequently, a corona charger to which a discharge voltage of +4.5 kV is applied is utilized to effect the secondary charging of the positive polarity in darkness, whereupon the surface potential of the photosensitive member is measured to be −400 V.

A commercially available fluorescent lamp producing green light is utilized to illuminate the original, with its reflected light being used in a slitwise exposure technique to effect an imagewise exposure of the photosensitive member. As a result, the surface potential of the photosensitive member is +350 V in exposed areas and is −380 V in non-exposed areas.

A coherent light output from a semiconductor laser of GaAs type, a test product of RICOH and emitting laser radiation of a wavelength 750 nm or in the red region of the electromagnetic spectrum, is formed into a light spot having an extremely small diameter, which spot is used to effect a line scanning of the exposed areas of the photosensitive member. The reference intensity of the laser radiation corresponds to an output of 4 mW, and the modulation takes place that the first write signal converts the output to zero while the second write signal increases the output to 10 mW. As a result, the surface potential of the photosensitive member is zero in those areas which are scanned by the light spot having the reference intensity, −330 V in those areas which are scanned by the light spot having the output of 10 mW, and +340 V in those areas which are scanned by the laser radiation having the output of 0 mW.

Electrostatic latent images of two opposite polarities which are thus formed on the photosensitive member are converted into visual image by utilizing a red toner which is negatively charged and a black toner which is positively charged. The developing process is effected by a magnetic brush technique in the forward direction. The developing is initially performed using the red toner, followed by the developing with the black toner.

Subsequently, a discharge voltage of +4.5 kV is applied to a corona charger, which charges the polarity of the visual images of the two colors to a common, positive polarity. By utilizing a corona charger to which a discharge voltage of −5.5 kV is applied, the two-color image is electrostatically transferred onto a record sheet which is formed by a common paper and is then thermally fixed to provide a two-color image which exhibits a sharp and clear image definition.

The photosensitive member is neutralized by an a.c. corona discharge of 3.8 kV. It is to be understood that the imagewise exposure and the line scanning by the light spot may take place simultaneously.

It is to be noted that with the prior art process, no recording of an image could be made in an area where there is an overlap between the write signals applied to the dual light used for the scanning of the photosensitive member. However, with the process of the invention, only one of the write signals may be employed to avoid such problem.

What is claimed is:

1. A process of synthesizing and recording images comprising the steps of:

providing a photosensitive member including an electrically conductive substrate having at least first and second photoconductive layers disposed thereon wherein one of said photoconductive layers is principally rendered conductive when it is irradiated with light of a color A and the other of said photoconductive layers is principally rendered conductive when it is irradiated with light of a color B;

charging said first and second photoconductive layers to opposite polarities from each other by a primary charging by a corona charging, followed by a secondary charging of the opposite polarity from the primary charging in darkness by a corona charging, said secondary charging being to a degree less than the primary charging;

exposing the photosensitive member to a first image of a original which is formed by light of the color A to reduce the potential on the surface of the photosensitive member in exposed areas;

simultaneously with or subsequent to said exposure, scanning the exposed areas of the photosensitive member with a light spot of color B having a reference intensity serving to dissipate the surface potential on said photoconductor;

modulating the intensity of said spot by a pair of signals corresponding to an image to be combined with said first image, the first of said signals serving to lower the intensity of said spot below its reference intensity, and the second of said signals serving to raise the intensity of said spot above its reference intensity, whereby electrostatic latent images corresponding to the pair of write signals can be formed on the exposed areas of the photosensitive member by respective distribution of surface potentials of the opposite polarities.

and developing the electrostatic latent image formed from the combined effects of said exposure step and said scanning step into visual images by utilizing two toners which are charged to opposite polarities.

2. A process of synthesizing and recording images according to claim 1 in which the photosensitive member comprises the conductive substrate and the first and the second photoconductive layer.

3. A process of synthesizing and recording images according to claim 1 in which the photosensitive member includes an intermediate layer located between the photoconductive layers, a transparent dielectric film lying over one of the photoconductive layers and a dielectric layer lying over the conductive substrate, and the first and the second photoconductive layer, thus providing a composite structure including four or more layers.

4. A process of synthesizing and recording images according to claim 2 or 3 in which the interface between the conductive substrate and the first conductive layer exhibits a rectifying effect upon a charge of a given polarity.

5. A process of synthesizing and recording images according to claim 2 or 3 in which the photosensitive member is in the form of a sheet and wherein a visual image developed on the photosensitive member is fixed to the photosensitive member itself.

6. A process of synthesizing and recording images according to claim 2 or 3 in which the photosensitive member is in the form of a drum and wherein a visual image developed on the photosensitive member is transferred onto a record sheet and fixed thereon, the photosensitive member being subjected to a neutralizing and a cleaning step subsequent to the transfer of the visual image.

7. A process of synthesizing and recording images according to claim 2 or 3 in which the primary charging of the photosensitive member is performed under a uniform illumination with light of either the color A or B.

8. A process of synthesizing and recording images according to claim 4 in which the primary charging of the photosensitive member is performed in darkness.

9. A process of synthesizing and recording images according to any one of claims 1, 2 or 3 in which an original is illuminated with light of the color A, and reflected light from the original is focused onto the photosensitive member through an imaging optical system, thus effecting an exposure of the photosensitive member.

10. A process of synthesizing and recording images according to any one of claims 1, 2 or 3 in which an original is illuminated with white light, and a filter which selectively transmits light of the color A is disposed in an optical path of an imaging optical system which focuses reflected light from the original onto the photosensitive member.

11. A process of synthesizing and recording images according to any one of claims 1, 2 or 3 in which the pair of toners charged to the opposite polarities and which are used to develop the electrostatic latent images are of a same color.

12. A process of synthesizing and recording images according to any one of claims 1, 2 or 3 in which the pair of toners charged to the opposite polarities and which are used to develop the electrostatic latent images are of different colors.

13. A process of synthesizing and recording images according to claim 1 in which the drum-shaped photosensitive member includes an aluminium drum which forms the conductive substrate, and wherein the first photoconductive layer comprises a layer of $As_2Se_3$ which is directly evaporated on the peripheral surface of the aluminium drum to a thickness of about 35μm at the substrate temperature of 74° C., the intermediate layer is a layer of polyester resin containing Rose Bengal which is deposited to a thickness of about 1.5μm, and the second photoconductive layer is a layer of an organic photoconductive material of a thickness of about 22μm whereby the photosensitive member is formed by the conductive substrate, the first and the second photoconductive layer and the intermediate layer.

14. A process of synthesizing and recording images according to claim 13 in which the drum-shaped photosensitive member is set in motion with a peripheral speed of 78 mm/sec while effecting a primary charging in darkness with a corona charging utilizing a discharge voltage of −6.5 kV and effecting a secondary charging in darkness with a corona charging utilizing a discharge voltage of +4.5 kV, thus establishing a surface potential of the photosensitive member which is equal to −400 V, exposing the photosensitive member to a light image of an original utilizing light of a green color, effecting a line scanning by a spot of laser radiation of a wavelength corresponding to a red color, subsequent to the developing of the visual image, the latter being uniformly charged to a positive polarity with a corona charging of a discharge voltage of +4.5 kV, thereafter utilizing a corona charger to which a discharge voltage of −5.5 kV is applied to transfer the visual image onto a common paper, and neutralizing the photosensitive member by an a.c. corona discharge of +3.8 kV subsequent to the transfer of the visual image.

15. A process of synthesizing and recording images according to claim 14 in which one of the pair of toners used in the developing which is charged to the negative polarity exhibits a red color while the other toner which is charged to the positive polarity exhibits a black color, the developing process being performed by a magnetic brush developing technique in the forward direction with the image being initially developed by the red toner.

16. A process of synthesizing and recording images according to claim 14 in which the spot is defined by a laser radiation having a wavelength corresponding to a red color which is produced by a semi-conductor laser.

* * * * *